US008998736B2

(12) United States Patent
Bashak

(10) Patent No.: US 8,998,736 B2
(45) Date of Patent: Apr. 7, 2015

(54) BOWLING BALL ELEVATING ASSEMBLY FOR AN AUTOMATIC PINSETTER

(71) Applicant: Kegel, LLC, Lake Wales, FL (US)

(72) Inventor: Chuck Bashak, Tavares, FL (US)

(73) Assignee: Kegel, LLC, Lake Wales, FL (US)

( * ) Notice: Subject to any disclaimer, the term of this patent is extended or adjusted under 35 U.S.C. 154(b) by 0 days.

(21) Appl. No.: 13/800,635

(22) Filed: Mar. 13, 2013

(65) Prior Publication Data

US 2013/0260908 A1 Oct. 3, 2013

Related U.S. Application Data

(60) Provisional application No. 61/618,460, filed on Mar. 30, 2012.

(51) Int. Cl.

| | |
|---|---|
| ***A63D 5/08*** | (2006.01) |
| ***A63D 1/00*** | (2006.01) |
| ***A63D 5/02*** | (2006.01) |

(52) U.S. Cl.

CPC .. *A63D 1/00* (2013.01); *A63D 5/02* (2013.01); *A63D 5/08* (2013.01)

(58) Field of Classification Search

CPC ..... A63D 5/02; A63D 5/08
USPC ..... 473/54, 73, 98, 99, 106, 110, 111
See application file for complete search history.

(56) References Cited

U.S. PATENT DOCUMENTS

| | | | |
|---|---|---|---|
| 2,717,155 | A | 9/1955 | Huck |
| 2,729,449 | A | 1/1956 | Montooth |
| 2,892,632 | A | 6/1959 | Montooth |
| 2,949,300 | A | 8/1960 | Huck et al. |
| 5,167,412 | A | 12/1992 | Rochefort |
| 5,330,412 | A | 7/1994 | Stephens |
| 5,331,711 | A | 7/1994 | Kelly |
| 5,364,314 | A | 11/1994 | Burkholder et al. |
| 5,372,551 | A | 12/1994 | McCarthy et al. |
| 5,382,197 | A | 1/1995 | Koury |
| 5,391,116 | A | 2/1995 | Burkholder et al. |
| 5,393,269 | A | 2/1995 | Atkinson, Jr. |
| 5,429,554 | A | 7/1995 | Burkholder |

(Continued)

OTHER PUBLICATIONS

Brunswick Model A-2 Automatic Pinsetter Service Manual, Cover, title page, table of contents, Introduction pp. 1-3, Figures 1 and 2 p. 4, and Chapter 7 pp. 25 and 27-32 (15 total pages), copyright Jan. 1988 by the Brunswick Bowling and Billiards Corporation, Muskegon, Michigan.

*Primary Examiner* — William Pierce
(74) *Attorney, Agent, or Firm* — Hovey Williams LLP

(57) ABSTRACT

A bowling ball elevating assembly for an automatic pinsetter includes an idler pulley assembly having an idler arm and a tension spring causing the idler arm to maintain tension on a ball wheel belt driving a ball elevating ring member. An adjustment arm and a tension arm are mounted to an idler pulley shaft enabling adjusting the amount of tension applied by the tension spring to the idler arm, and consequently the tensioning force applied by an idler pulley to the ball wheel belt, thereby permitting slippage of the ball wheel belt relative to the ball elevating ring member when bowling pins and a bowling ball become jammed in the pinsetter. An improved idler v-pulley wheel has a reduced frictional engagement with the ball wheel belt, and improved positioning of the ball lift drive belt pulley reduces stress on the ball wheel belt.

11 Claims, 8 Drawing Sheets

(56) References Cited

U.S. PATENT DOCUMENTS

| | | | |
|---|---|---|---|
| 5,439,418 | A | 8/1995 | Stephens |
| 5,447,473 | A | 9/1995 | Scripps |
| 5,536,211 | A | 7/1996 | Kelly |
| 5,569,092 | A | 10/1996 | Rochefort |
| 5,616,084 | A | 4/1997 | Heddon et al. |
| 5,624,323 | A | 4/1997 | Delaney et al. |
| 5,709,608 | A | 1/1998 | Koury |
| 5,759,108 | A | 6/1998 | Heddon |
| 5,820,474 | A | 10/1998 | Delaney et al. |
| 5,876,290 | A | 3/1999 | Hermanson et al. |
| 6,027,411 | A | 2/2000 | Huhne |
| 6,358,155 | B1 | 3/2002 | Huhne |
| 6,508,354 | B2 | 1/2003 | Breed et al. |
| 6,533,673 | B2 | 3/2003 | Wilson |
| 6,537,157 | B1 | 3/2003 | Dziura et al. |
| 7,044,862 | B1 | 5/2006 | Scripps |
| 7,104,896 | B2 | 9/2006 | Wood |
| 7,115,040 | B1 | 10/2006 | Thorson et al. |
| 7,156,746 | B2 | 1/2007 | Scripps |
| RE39,886 | E | 10/2007 | Wilson et al. |
| 7,591,732 | B2 | 9/2009 | Speigl |
| 7,704,152 | B1 | 4/2010 | Thorson |
| 2002/0036129 | A1 | 3/2002 | Breed et al. |
| 2003/0036435 | A1 | 2/2003 | Wilson |
| 2004/0162152 | A1 | 8/2004 | Augustus |
| 2004/0259650 | A1 | 12/2004 | Wilson et al. |
| 2005/0101398 | A1 | 5/2005 | Thorson et al. |
| 2005/0176516 | A1 | 8/2005 | Thorson et al. |
| 2006/0105848 | A1 | 5/2006 | Krol |
| 2006/0211508 | A1 | 9/2006 | Speigl |
| 2006/0223645 | A1 | 10/2006 | Scripps |
| 2008/0182676 | A1 | 7/2008 | Recknagel et al. |
| 2010/0197418 | A1 | 8/2010 | Uto |

BOWLING BALL ELEVATING ASSEMBLY FOR AN AUTOMATIC PINSETTER

This application claims the benefit of U.S. Provisional Patent Application No. 61/618,460 filed Mar. 30, 2012, the entire disclosure of which is incorporated herein by reference.

BACKGROUND OF THE INVENTION

1. Field of the Invention

The present invention concerns an improved bowling ball elevating assembly for automatic pinsetters. More particularly, it is concerned with a bowling ball elevating assembly including a ball wheel drivebelt assembly having a modified idler arm and pulley which permits slippage of the elevating drive to reduce or avoid damage to bowling balls when a bowling pin and bowling ball are jammed together in the pinsetter.

2. Description of the Prior Art

Automatic pinsetters are well known mechanisms which have drastically reduced labor in bowling centers by avoiding the necessity of human pinsetters. These automated pinsetters perform a variety of functions including sweeping pins from the pin deck, positioning pins for play, and returning the bowled bowling ball back to the approach area for the resumption of play. One such automated pinsetting device is shown in U.S. Pat. No. 2,949,300, the entire disclosure of which is incorporated herein by reference.

Another automated pinsetter in widespread usage and well-known construction is the Brunswick Model A-2 by Brunswick Bowling & Billiards Corporation of Muskegon, Mich. In this machine, fallen pins and the bowling ball travel to an upwardly-movable pit cushion after the bowling ball is rolled through the pin deck. The pit cushion is disposed above a pit conveyor to receive the impact of the rolled ball and flying pins and functions to prevent the passage of a ball to the rear of the pit cushion when the latter is in its lower position, and also to initiate operation of the machine upon movement of the pit cushion caused by the impact of the ball. The impact of the ball causes the pit cushion to rise, which in turn allows the bowling ball to pass under the pit cushion to the ball elevator.

In the Brunswick Model A-2, the ball elevating mechanism includes a ring-shaped member mounted for rotation on guide rollers. A pair of curved, generally vertically disposed tracks are located within and cooperate with the ring-shaped member to form a three-point contact with the ball, and together the tracks and the ring-shaped member elevate the ball to the track mechanism. The track mechanism is provided as three substantially parallel rods which together form a track, and which are supported by a framework. The framework is supported from a bar extending across kickbacks. The ball elevating ring is driven by a belt which is driven by a pulley on a ball ring drive shaft.

The pin elevating mechanism includes a pin elevating ring member which has pin-receiving pockets spaced apart around its inner periphery for elevating pins in succession to a tray. The ring member is support for rotation on guide rollers and is driven by a belt extended around the outer periphery of the ring member, the belt being driven by a pin ring drive shaft. The shafts are driven by a motor which is connected to the shafts by pulleys and belts. When carried from the pit to the pin elevating mechanism, the pins then travel in succession via the pin elevating mechanism into a tray where they are oriented to travel butt end first to a cross conveyor. The cross conveyor carries the pins forwardly and upwardly to a discharge point where they move in succession into pockets in a turret. The turret sets the pins in a upright orientation on the pin deck part of the lane surface for the next bowling ball roll.

Although this system has proven to be functional, it is believed that improvements can be made in order to improve its operation.

SUMMARY OF THE INVENTION

It is a goal of the present invention to provide an improvement to an existing automatic pinsetting device by changing the position of the ball lift drive belt pulleys. It has been learned that current ball lift drive belt pulleys are placed at a relatively low position in the pinsetter causing the belt to be in a position that causes undue stress.

It is another goal of the present invention to provide an improvement to an existing automatic pinsetting device by controlling the tautness of the ball wheel drive belt. It has been learned that in the current pinsetter there is no mechanism or means for adjustment to control the tautness of the ball wheel drive belt so as to ensure that it functions properly over an extended period of time.

It is a yet further goal of the present invention to provide an improvement to an existing automatic pinsetting device in order to limit the damage caused to a bowling ball. It has been learned that in the current pinsetter the bowling ball may be damaged by either a drive belt pulley which is made of steel or by jammed bowling pins, either of which may maintain friction between the bowling ball and the drive belt in the case of a jammed pin in the ball wheel track.

These and other objects have largely been met by the improved bowling ball elevating assembly for automatic pinsetters of the present invention.

The present invention addresses these objects by the provision of a modified bowling ball elevating assembly that acts to eliminate or at least substantially reduce stress on the bowling ball wheel drive belt through improved positioning of the pulley system. Rather than the current pulley system which puts the belt in an unnatural position resulting in premature wear and added maintenance expense to bowling centers, the present invention raises the position of the ball lift drive belt pulley and thereby allows the bowling ball wheel drive belt to move along a more direct path and avoids the serpentine routing of the belt in current ball elevating mechanisms.

The present invention also addresses the goal of providing the ability to adjust the tautness of the ball wheel drive belt. By the use of an idler arm adjusting collar, the present invention allows tension to be removed from the drive belt and upon release of the idler arm, the bowling ball wheel drive belt will seat at a maximum height. This avoids an over travel which would in turn create stressful contact to the out of range linkage directly above the bowling ball elevating assembly.

Furthermore, the present invention addresses the goal of eliminating or reducing damage to a bowling ball caused by jammed pins. In current automatic pinsetters, the flight of the pins after being struck by the rolled bowling ball may result in pins becoming lodged between the pit cushion and the ball lift assembly. Because the ball wheel does not stop moving, the bowling ball continuously rubs against the jammed pin causing irreparable damage to the bowler's ball, often owned by the bowler. The present invention provides an improved v-pulley wheel in the bowling ball elevating assembly which is made of a material having a lower coefficient of static friction ($\mu$) between steel and hard rubber, of less than about 0.70. Thus, the preferred v-pulley wheel may be made of aluminum, which has a coefficient of static friction with hard rubber of about 0.51. The selected synthetic resin pulley composition reduces the frictional engagement or traction between the pulley and the belt, such that when a pin jams against the bowling ball in the pinsetter, the pulley ceases driving the belt. Accordingly, the ring-shaped member of the bowling ball elevating assembly ceases to rotate, thereby eliminating the force being applied to urge the pin against the bowling ball to thus prevent or at least substantially reduce the damage that would normally occur in existing pinsetters.

These and other advantages will be readily appreciated by those skilled in the art with reference to the drawings and description which follow.

DESCRIPTION OF THE PREFERRED EMBODIMENT

Figure 1:
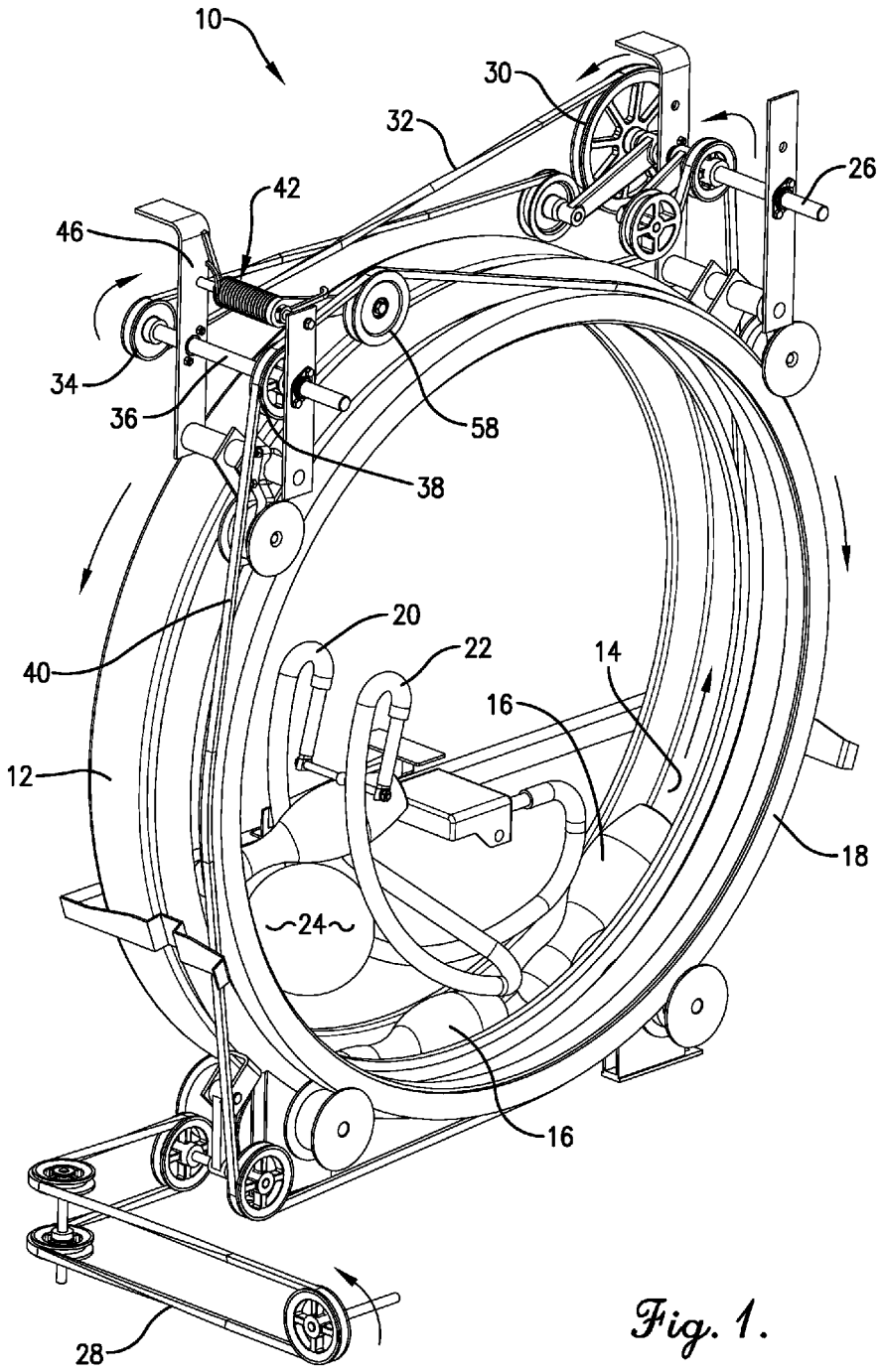
FIG. 1 is a left rear perspective view of the bowling ball elevating assembly of an automatic pinsetter showing both the bowling ball elevating ring and the pin elevating ring member.
Figure 2:
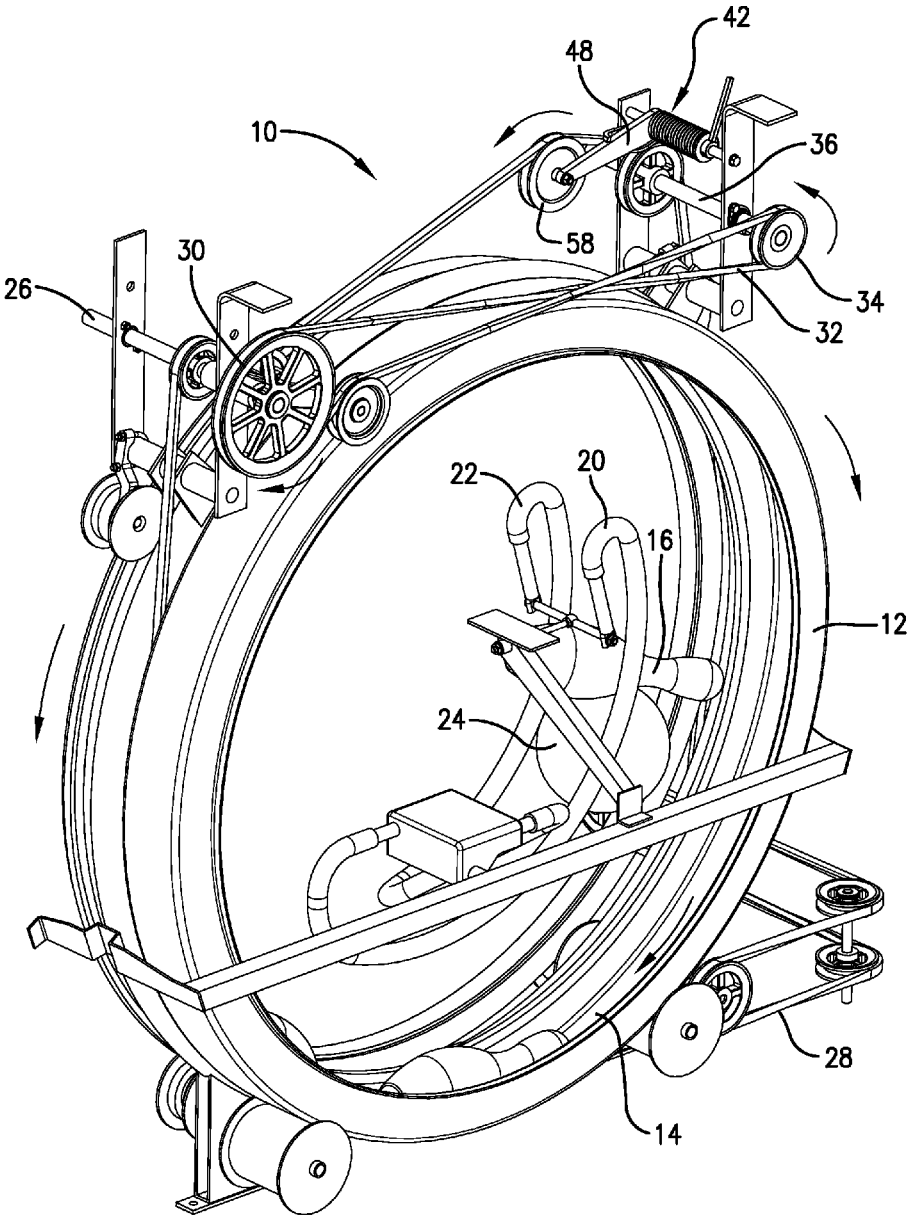
FIG. 2 is a right front perspective view of the bowling ball elevating assembly of an automatic pinsetter showing the routing of the ball elevating wheel drive belt.
Figure 3:
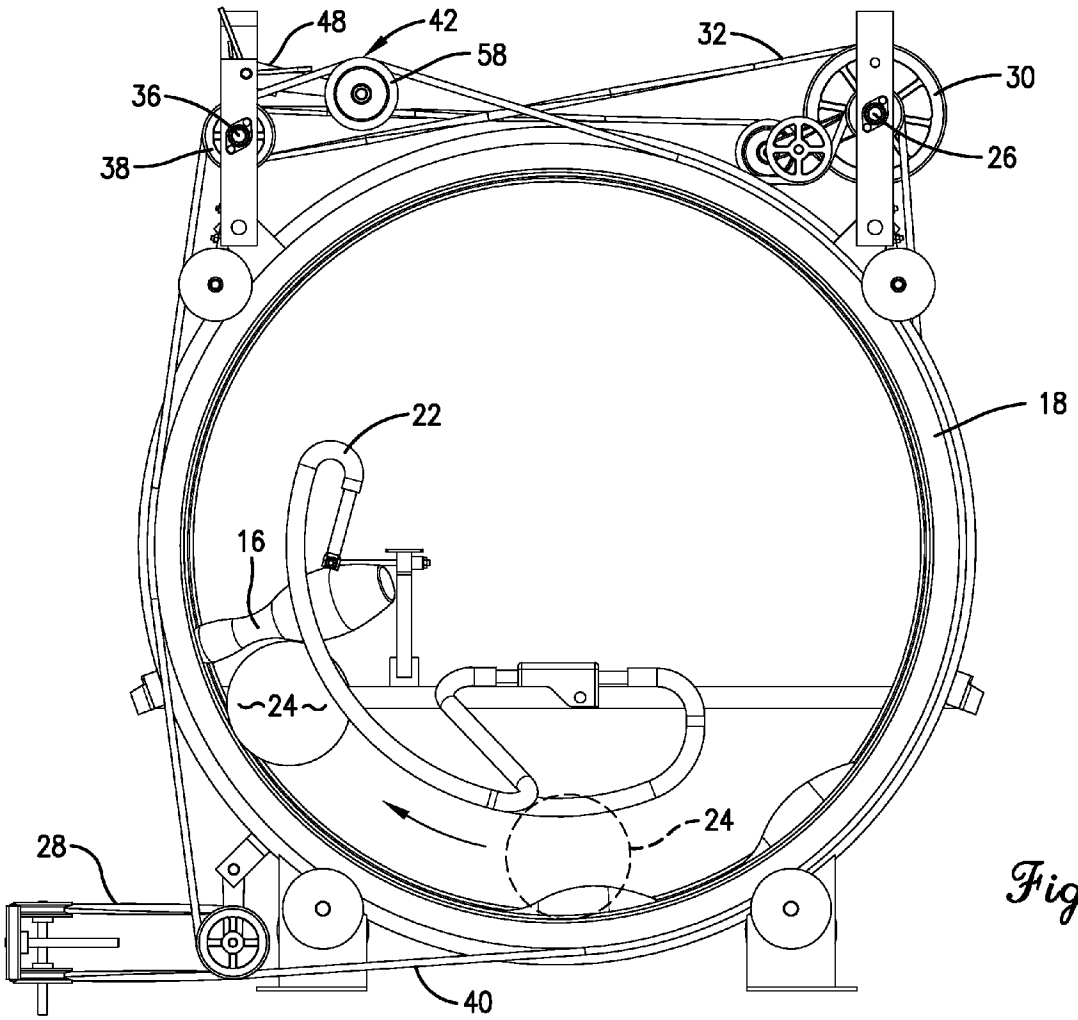
FIG. 3 is a rear elevational view of the bowling ball elevating assembly hereof, showing the movement of a bowling ball from an initial position shown in broken lines upwardly along the ball lift rods.

Referring now to the drawings, FIGS. 1, 2 and 3 show a portion of an automatic pinsetter 10, more particularly parts of the ball and pin elevating mechanisms. The pin elevating mechanism includes a pin elevating ring member 12 which includes pin-receiving pockets 14 configured for elevating bowling pins 16 upwardly for deposit onto a turnaround pan (not shown) which receives the pins 16 and orients them for delivery via a cross-conveyor to a turret. The ball elevating mechanism includes a ball elevating ring member 18 and a pair of ball lift rods 20 and 22. A bowling ball 24 delivered by the bowler is received in a pit at the rear of the pin deck and then travels to the ball elevating ring member 18. The pin elevating ring member 12 and the ball elevating ring member 18 are constantly rotating, but in opposite directions as shown by the arrows in FIGS. 1, 2 and 3. Typically, a single electric motor (not shown) is operatively coupled to a cross shaft 26 for driving both the pin elevating ring member 12 and the ball elevating ring member 18, as well as the pit conveyor drive belt 28.

In greater detail, the cross shaft 26 causes the ball elevating ring member 18 to rotate via a jack shaft drive pulley 30 which drives a jack shaft belt 32 to rotate sheave 34. Sheave 34 in turn rotates drive shaft 36 and drive shaft pulley 38 driven therewith. The drive shaft pulley 38 drives ball wheel belt 40 which passes around and engages the ball elevating ring member 18 as shown in FIGS. 1, 2 and 3. The ball wheel belt 40 does not define a path of travel in excess of 360°.

Figure 8:
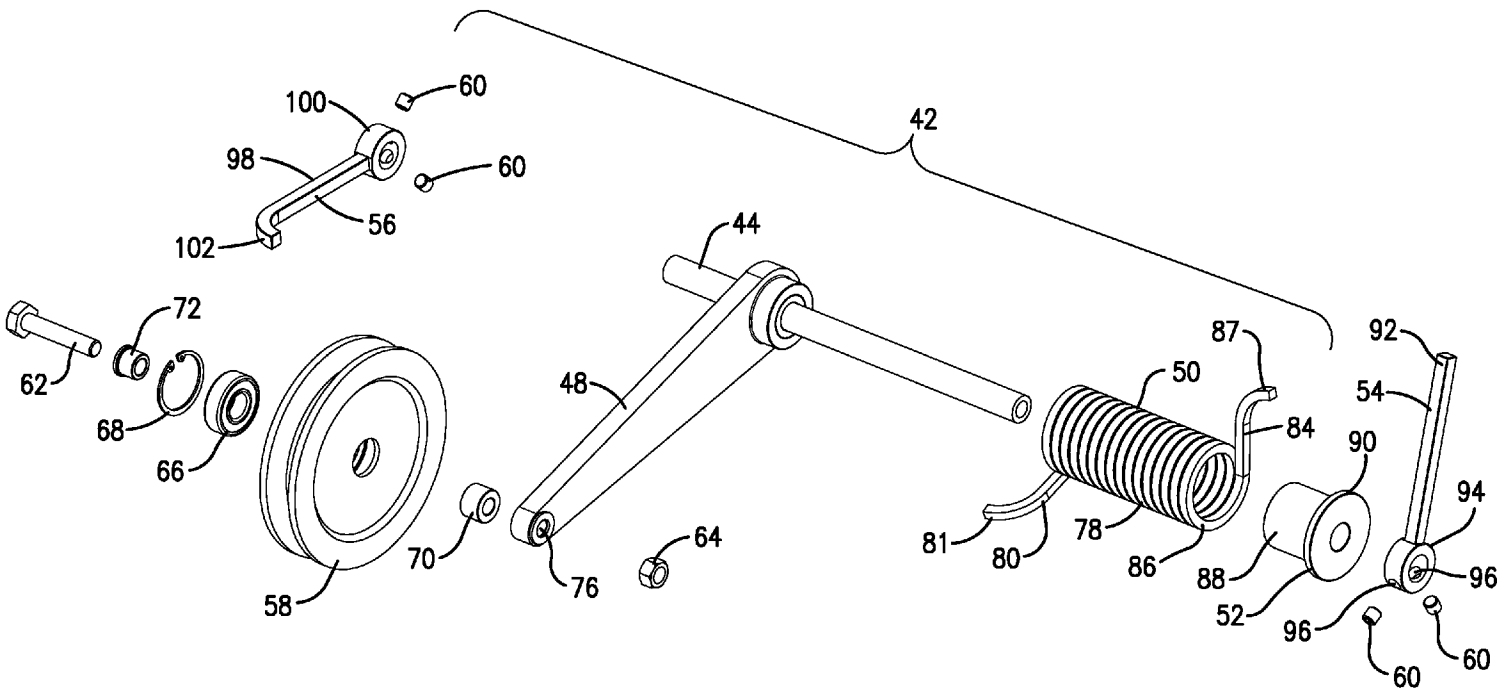
FIG. 8 is an exploded view in perspective showing the idler pulley assembly components.

An idler pulley assembly 42 is used to maintain sufficient tension on the ball wheel belt 40 to cause it to rotate the ball elevating ring member 18. The idler pulley assembly 42 includes an idler pulley shaft 44 mounted to a frame 46 which positions the drive shaft 36 preferably above the ball elevating ring member 18 and on the opposite side of the ball elevating ring member 18 of the cross shaft 26 as shown in FIG. 3. The idler pulley shaft 44 may be positioned above the drive shaft 36 on the frame 46. The idler pulley assembly may further include idler arm 48, tension spring 50, idler arm spring bushing 52, adjustment arm 54, stop arm 56, idler v-pulley wheel 58, alien screws 60, bolt 62, nut 64 which is threaded onto an end of the bolt 62, ball bearing 66, snap ring 68, spacer 70 and bearing spacer ring 72. As may be seen in FIG. 8, a bushing 74 may be journalled between the idler pulley shaft 44 and the idler arm 48. The idler arm 48 has a proximate portion 108 mounted to the idler pulley shaft 44 to permit pivoting movement of the idler arm 48 relative to the idler pulley shaft 44, and the idler v-pulley wheel 58 is mounted to a remote portion 110 of the idler arm 48 for rotation. Thus, the idler arm 48 pivots about the idler pulley shaft 44 and the idler v-pulley wheel 58 rotates about the axis defined by the bolt 62, the bolt 62 passing through the hole 76 in the remote end of the idler arm 48. The idler v-pulley wheel 58 may be made of aluminum, which has a coefficient of static friction ($\mu$) with hard rubber of less than 0.70, more preferably less than about 0.51. The drive shaft pulley 38 and the idler v-pulley wheel 58 are configured, positioned and arranged such that the ball wheel belt 40 does not engage greater than a 90° sector of either the drive shaft pulley 38 or the idler v-pulley wheel 58.

The tension spring 50 is also preferably mounted to the idler pulley shaft 44 and configured with a coil spring core section 78 and includes a finger 80 which extends radially outwardly beyond the core section 78. The finger 80 is positioned at a proximate end 82 which is proximate to the idler arm 48 having a proximately extending bend 81 for engaging the idler arm 48. The tension spring 50 also includes a bail 84 which extends radially outwardly beyond the core section 78 and is located at a remote end 86 of the tension spring 50 and positioned proximate to the adjustment arm 54 and has a remotely extending tip 87 for engaging the adjustment arm 54. The spring bushing 52 includes a cylindrical insert portion 88 positioned internally of the coil spring core section 78 for supporting the tension spring 50 on the idler pulley shaft 44, and a rim 90 for limiting translational movement of the tension spring longitudinally along the idler pulley shaft 54.

The adjustment arm 54 includes an elongated lever arm 92 and a first collar 94, the first collar 94 being sized and configured for mounting on the idler pulley shaft 44. The adjustment arm 54 may thus be adjustably fixed relative to the idler pulley shaft 44. The first collar 94 is circular and circumferentially surrounds a portion of the idler pulley shaft. The first collar may be provided with at least one and preferably a plurality of threaded holes 96 for receiving the allen screws 60 as set screws or fixing elements therein for adjustably fixing the position of the adjustment arm 54 relative to the idler pulley shaft 44. It may be appreciated that other means of adjustably fixing the adjustment arm 54 to the idler pulley shaft could be used, but the use of set screws provides the ability to make fine adjustments to the relative position of the adjustment arm 54 on the idler pulley shaft 44. Similarly, the stop arm 56 includes a leg 98 and a second collar 100 sized and configured for mounting on the idler pulley shaft 44. The leg 98 may be provided with a curved terminal section or hook 102 for engaging and limiting movement of the idler arm 48 away from the ball elevating ring member 18 and thus limits the maximum tensioning force which may be applied by the idler v-pulley wheel against the ball wheel belt 40. The second collar 100 may include at least one and preferably a plurality of threaded holes 104 for receiving therein allen screws 60 as set screws or fixing elements which provide a means of adjustably fixing the stop arm 56 relative to the idler pulley shaft 44. The hook 102 of the leg 98 is positioned on one edge 104 of the idler arm 48 and prevents rotational or pivotal movement of the idler arm 48 past the hook 102. The proximately extending bend 81 of the torsion spring 50 abuts an opposite second edge 106 to bias the idler arm 48 to pivot about the idler pulley shaft 44 rotationally towards and into engagement with the stop arm 56.

The bolt 62 passes through the bearing spacer ring 72 and supports the bearing 66 to permit the idler pulley wheel 58 to freely rotate, the bolt 62 thus defining an axis of rotation for the idler pulley wheel 58 which is spaced from the idler pulley shaft which defines a pivot axis for the idler arm 48.

Figure 4:
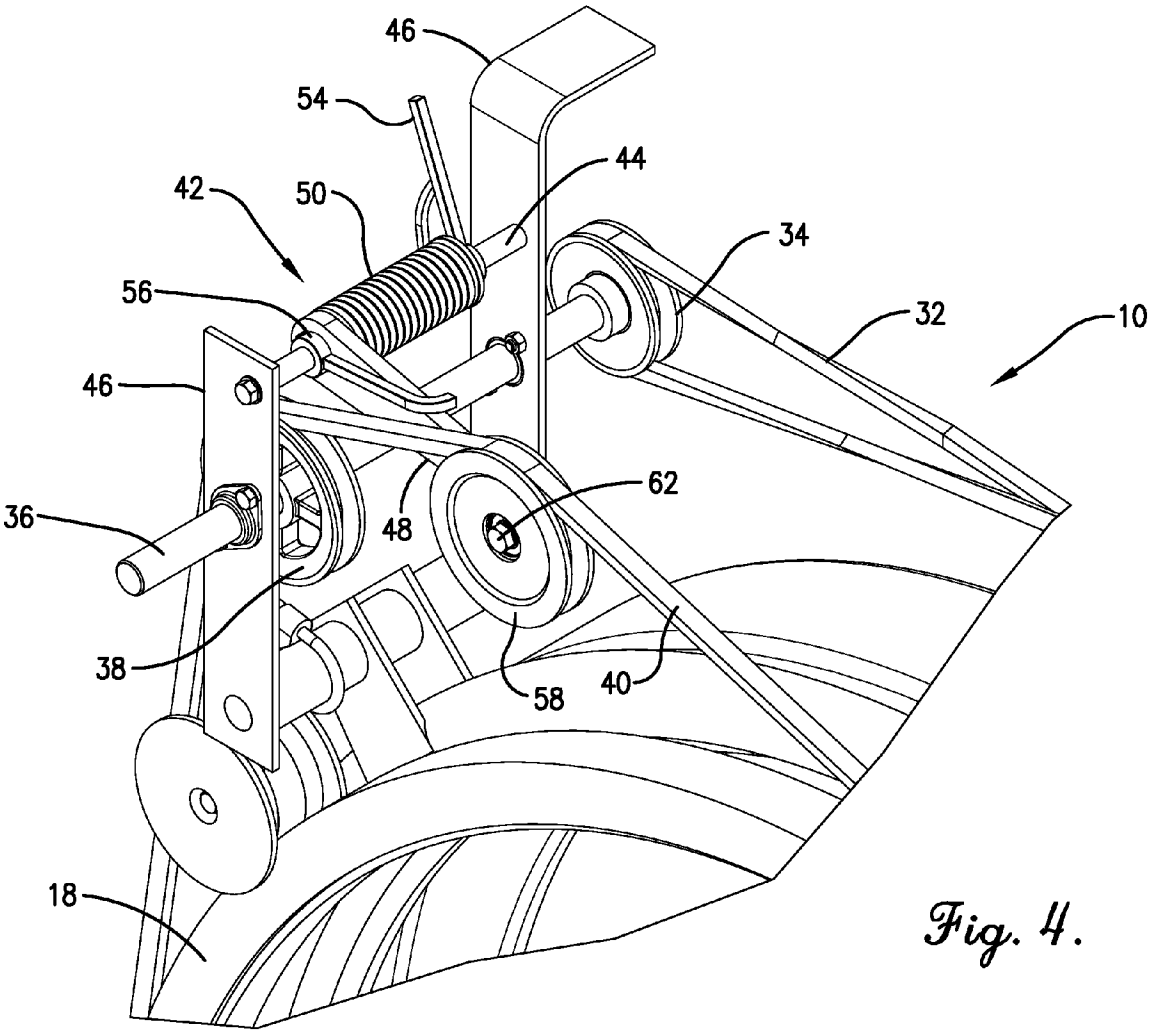
FIG. 4 is an enlarged top right perspective view of the ball elevating wheel drive belt passing over an idler pulley assembly including an idler arm adjusting collar.
Figure 5:
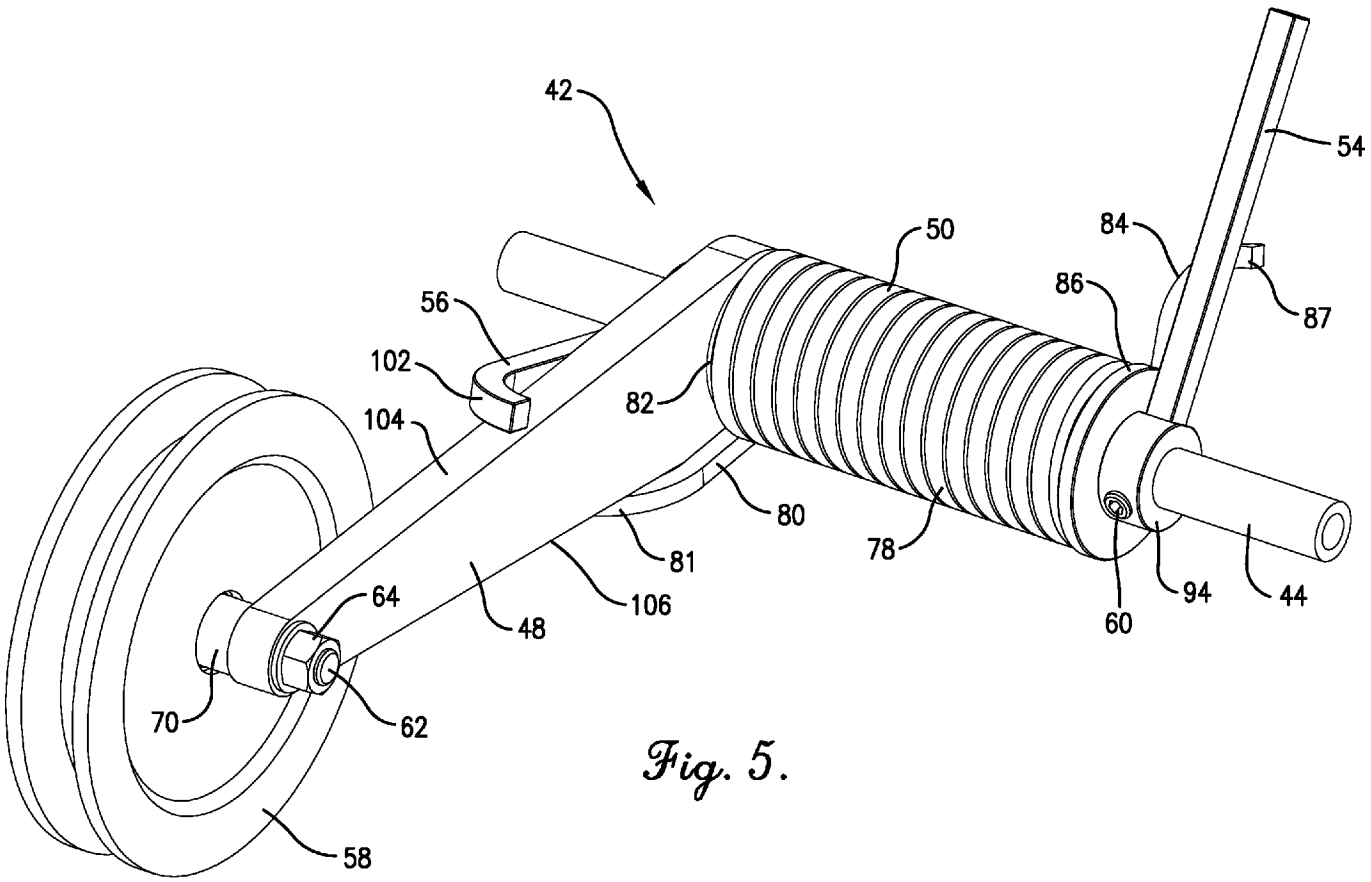
FIG. 5 is an enlarged right rear perspective view of the idler pulley assembly showing the idler arm adjusting collar, tension arm, tension spring, idler arm and pulley mounted to an idler shaft.
Figure 6:
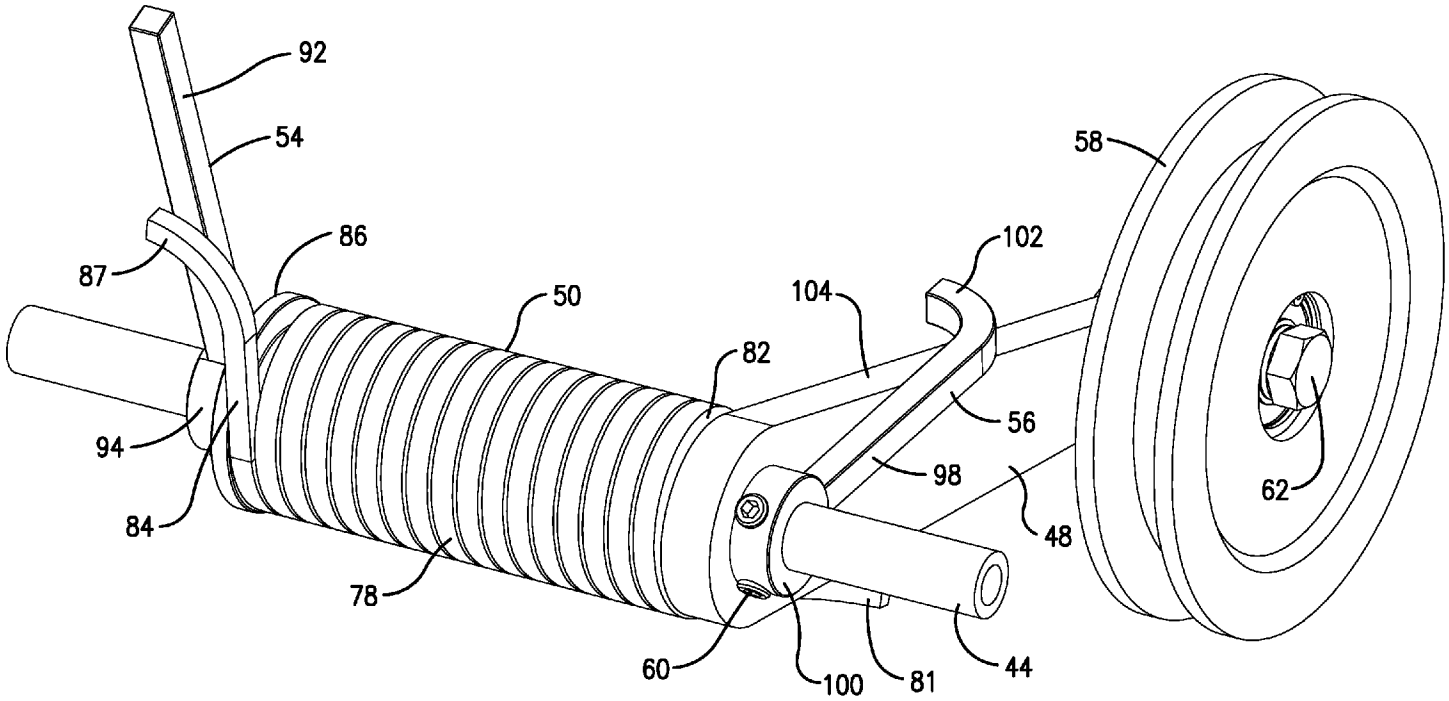
FIG. 6 is an enlarged left front perspective view of the idler pulley assembly showing the tension arm in greater detail.
Figure 7:
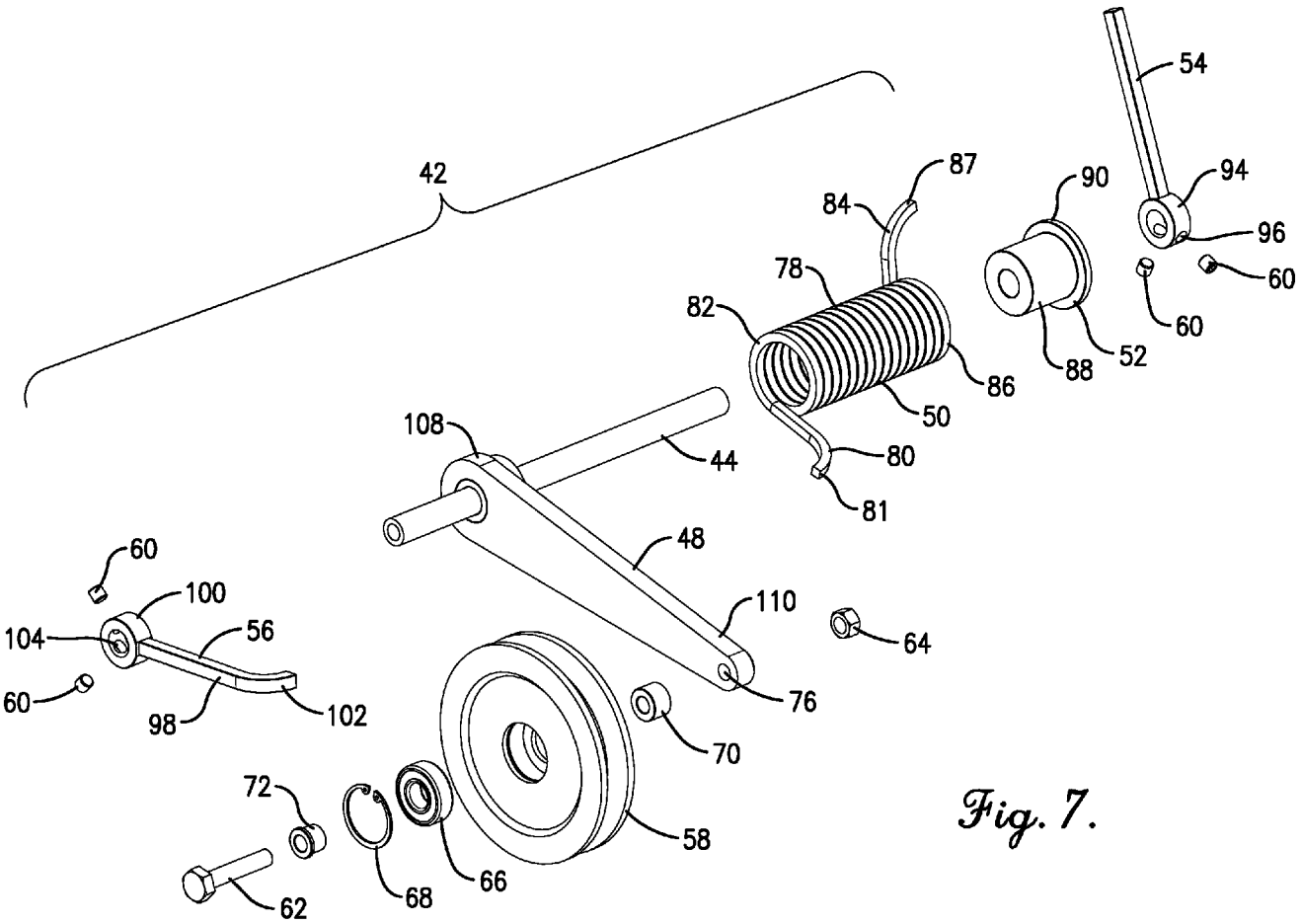
FIG. 7 is an exploded view in perspective showing the idler pulley assembly components.

In use, the adjustment arm 54 engages the bail 84 of the torsion spring 50 as shown in FIGS. 4 and 5, for example, and is rotated relative to the idler pulley shaft 44 until the torsion spring 50 exerts the desired amount of biasing force against the idler arm 48. Thus, the idler arm 48 is permitted to move in a rotational direction away from the stop arm 56 only to the extent the force on the idler arm 48 is able to overcome the biasing force applied thereto by the torsion spring 50. For example, as seen in FIG. 5, if the alien screws 60 on the first collar 94 are loosened and the adjustment arm 54 is pivoted in a counterclockwise direction, once the alien screws 60 are again tightened to fix the adjustment arm relative to the idler pulley shaft 44, the biasing force applied by the torsion spring 50 to the idler arm 48 is reduced and the idler arm 48 may more easily be moved rotationally away from the stop arm 56. The amount of biasing force to be applied by the torsion spring 50 is determined by the amount of slippage between the ball wheel belt 40 and the ball elevating ring member 18 desired by the bowling center operator.

When operating normally, the ball wheel belt 40 is maintained in tension by the idler pulley assembly 42 so that the ball wheel belt continuously rotates the ball elevating ring member 18. However, when a bowling ball 24 moves from the broken line position shown in FIG. 3 to the solid line position and pin 16 jams a bowling ball 24 in the position shown by the solid line depiction of the bowling ball 24 in FIG. 3, continued rotation of the ball elevating ring member 18 is undesirable as such continued rotation results in the pin 16 continuing to impact against the bowling ball 24. This jamming of the pin and ball places greater tension on the ball wheel belt 40, and the assembly 42 comes into play to cause belt 40 to stop, thereby also stopping rotation of ring member 18. This is accomplished by the positioning of the idler pulley assembly, the provision of the torsion spring 50 with the ability to adjust the amount of biasing force provided by the adjustment arm 54 and the geometry of the idler arm 48, and by the use of an idler v-pulley wheel 58 of a lower μ value of less than about 0.70, for example aluminum or a synthetic resin. The adjustment arm 54 permits the bowling center operator to adjust the tension to be applied by the torsion spring to that needed depending on the condition of the ball wheel belt 40 (for example, the amount it has stretched over time, the amount of frictional engagement with the ball elevating ring member 18 and the drive shaft pulley 38) so that the ball wheel belt 40 rotates the ball elevating ring member 18 as desired during normal operation. When a jam occurs, the idler assembly 42 allows the idler arm 48 to slightly move away from the stop arm 56, to thereby stop the movement of belt 40. Consequently, the ring 18 stops rotating to prevent damage to the bowling ball 24 or pinsetter mechanism.

I claim:

1. In an automatic pinsetter including a rotatable pin elevating ring member and a bowling ball elevating assembly comprising a rotatable ball elevating ring member positioned adjacent the pin elevating ring member, first and second ball lift rods positioned radially interiorly of the ball elevating ring member, a shaft, and a ball wheel belt driven by the shaft and in engagement with the ball elevating ring member for rotating the ball elevating ring member, the improvement comprising:

a drive shaft pulley driven by the shaft and in engagement with the ball wheel belt, wherein the drive shaft pulley is positioned radially exteriorly of the ball elevating ring member; and a idler pulley assembly including an idler arm, a tension spring for biasing a remote end of the idler arm away from the ball elevating ring member, and an idler pulley wheel rotatably mounted proximate the remote end of the idler arm and in engagement with the ball wheel belt, wherein the drive shaft pulley and the idler pulley wheel are configured, positioned and arranged such that the ball wheel belt does not engage greater than a 90° sector of either the drive shaft pulley or the idler pulley wheel.

2. An automatic pinsetter as set forth in claim 1, wherein the ball wheel belt does not define a path of travel in excess of 360°.

3. An automatic pinsetter as set forth in claim 1, wherein the shaft is positioned above a horizontal plane passing through an uppermost point of engagement between the ball wheel belt and the ball elevating ring member.

4. An automatic pinsetter as set forth in claim 3, wherein an axis of rotation of the idler pulley wheel lies in a horizontal plane positioned above an axis of rotation of the shaft.

5. An automatic pinsetter as set forth in claim 1, wherein the ball wheel belt and the idler pulley wheel are provided of materials having a static coefficient of friction therebetween of less than about 0.70.

6. An automatic pinsetter as set forth in claim 5, wherein the ball wheel belt and the idler pulley wheel are provided of materials having a static coefficient of friction therebetween of less than about 0.51.

7. An automatic pinsetter as set forth in claim 1, wherein the idler pulley wheel is formed of aluminum.

8. An automatic pinsetter as set forth in claim 1, wherein the idler pulley assembly includes an adjustment arm adjustably mounted to the shaft and in engagement with a portion of the tension spring.

9. An automatic pinsetter as set forth in claim 8, wherein the adjustment arm includes a collar sized and configured for mounting on the shaft and at least one member connecting the collar to the shaft for fixing the position of the adjustment arm relative to the shaft.

10. An automatic pinsetter as set forth in claim 9, wherein the adjustment arm includes a lever arm extending from the collar in engagement with the portion of the tension spring, whereby changing the position of the adjustment arm relative to the shaft adjusts the force applied by the spring on the idler arm.

11. An automatic pinsetter as set forth in claim 1, wherein the idler pulley assembly includes a stop arm adjustably mounted to the shaft and positioned for engagement with the idler arm whereby the tension spring biases the idler arm into engagement with the stop arm.

* * * * *